United States Patent [19]

Korte et al.

[11] 4,366,003

[45] Dec. 28, 1982

[54] APPARATUS AND PROCESS FOR THE PERIODIC CLEANING-OUT OF SOLIDS DEPOSITS FROM HEAT EXCHANGER PIPES

[75] Inventors: Hans D. Korte, Brühl; Gustav Mück, Bornheim-Walberberg, both of Fed. Rep. of Germany

[73] Assignee: Degussa Aktiengesellschaft, Frankfurt am Main, Fed. Rep. of Germany

[21] Appl. No.: 210,434

[22] Filed: Nov. 25, 1980

[30] Foreign Application Priority Data

Nov. 30, 1979 [DE] Fed. Rep. of Germany ..... 2948201

[51] Int. Cl.[3] ..... B08B 3/02; B08B 5/02; B08B 9/02

[52] U.S. Cl. ..... 134/18; 134/22.12; 134/22.15; 165/1; 165/95; 15/316 A; 55/97

[58] Field of Search ..... 134/18, 20, 22.12, 22.15; 15/316 R, 316 A, 319, 406; 165/1, 95; 55/97

[56] References Cited

U.S. PATENT DOCUMENTS

| | | | |
|---|---|---|---|
| 2,069,574 | 2/1937 | Bowers | 165/95 |
| 2,717,658 | 9/1955 | Bethea et al. | 55/97 |
| 3,364,983 | 1/1968 | Krinov et al. | 165/1 |
| 3,827,102 | 8/1974 | Adiutori | 15/319 X |
| 4,141,754 | 2/1979 | Frauenfeld | 165/95 |

FOREIGN PATENT DOCUMENTS

| | | | |
|---|---|---|---|
| 457641 | 6/1949 | Canada | 15/316 R |

*Primary Examiner*—Richard V. Fisher

*Attorney, Agent, or Firm*—Beveridge, DeGrandi and Kline

[57] ABSTRACT

The invention concerns an apparatus and a process for the periodic cleaning out of the pipes of heat exchangers to remove deposits of finely-divided solids, in particular carbon black or pyrogenically produced inorganic oxides. The apparatus consists of jet nozzles, which are arranged at a spacing above the gas entry openings of the pipes and are supplied with a cleaning gas, having excess pressure with respect to the process gas, via ducts provided with shut-off elements. The jet nozzles can be stationary or arranged for displacement along a row of the heat exchanger pipes. The process envisages flushing the pipes to be cleaned preferably in succession during operation of the heat exchanger, periodically, with a gas stream released with an impact and maintained for a short time at high speed.

15 Claims, 4 Drawing Figures

Figure 1:
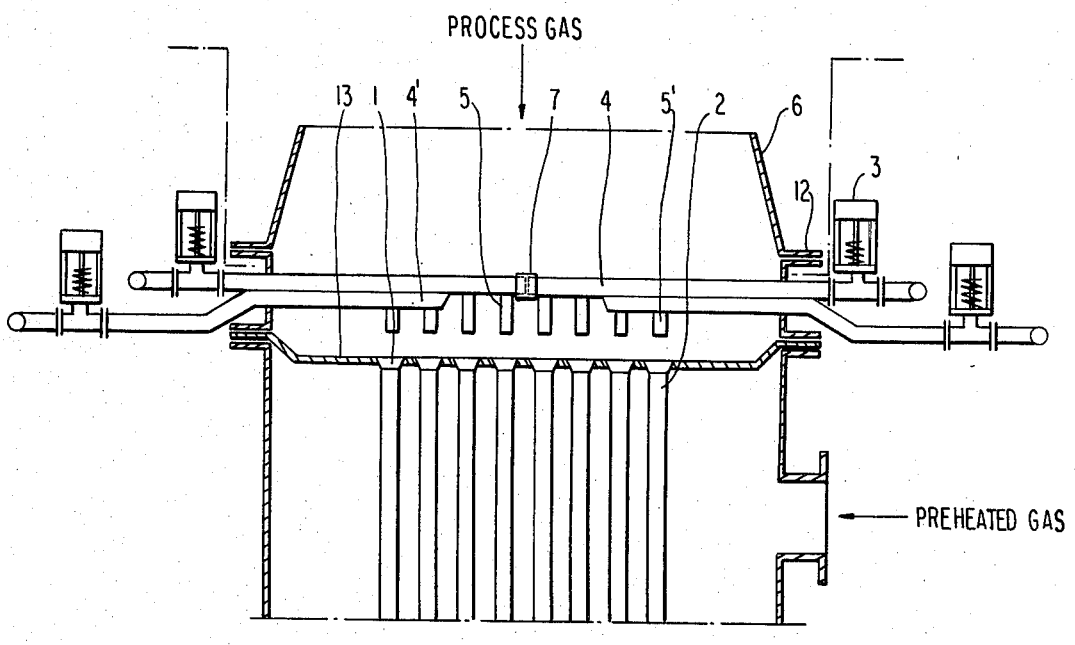

APPARATUS AND PROCESS FOR THE PERIODIC CLEANING-OUT OF SOLIDS DEPOSITS FROM HEAT EXCHANGER PIPES

The invention concerns an apparatus and a process for periodically cleaning deposits of the solid materials from the pipes through which a process gas flows, or from a single pipe, of a heat exchanger used for heat removal of a process gas stream containing a hot, finely-dispersed solid material.

In the separation of finely-dispersed solids which are formed in a thermal process such as carbon black production or the recovery of fumed silicas and are transported by a gas stream—in the cases mentioned, by their own process gas stream—the problem arises of removing heat from the transport gas in order to be able to deposit the solid in flexible tube filters or other devices and to be able to re-use the removed heat in the production process. The heat is here usually removed by heat exchangers, the exchange elements of which consist of tube bundles or single pipes, through which the transporting or process gas is conducted. According to the kind of suspended material contained in the gas stream, deposits thereof form on the internal walls of the pipes, reducing both the gas flow and the heat transfer. This occurrence can lead to complete blockage of individual pipes, which can result in damage to the heat exchanger. That is, when the pipe ends of tube bundle heat exchangers are attached as usual to or in the opposed end plates of the exchanger, the cooling of blocked pipes due to increasing heat insulation causes, in the neighborhood of hotter pipes, stresses in the material. The affected, shortened pipe can then be torn away by the neighboring pipes which overextend it.

There has thus existed for a long time a pressing need for a solution of the stated problem in tubular heat exchangers in processes in which a hot process gas or exhaust gas conveys with it a finely-divided solid product which must be separated from the previously cooled gas stream, without thereby having to interrupt the operation of the heat exchanger or without resort to expensive and maintenance-requiring mechanical cleaning apparatuses. The effect on heat exchangers in the production of carbon blacks and fumed silicas leads to particular problems, since these have a particularly strong tendency to deposit and build up because of their high surface activity.

It has now been found that the stated problems can be solved in a surprisingly simple and lasting manner with an apparatus which merely need to be built into the process gas inflow pipe.

The apparatus is characterized by jet nozzles adjusted or adjustable centrally over the gas inlet openings of the pipes and connected to at least one duct provided with shut-off elements for the periodic infeed of a cleaning gas having an excess pressure relative to the process gas.

The jet nozzles are arranged in a space above the gas inlet openings of the heat exchanger pipes such that the gas stream which is to clean away the layers of solid, as described herein, reaches the full cross section at the gas inlet opening of each pipe. Since the jet nozzles emit a fan-shaped gas stream, their outlet cross section also acts to determine the spacing. In general, the cross section of the nozzle openings is substantially smaller than the inlet cross section of the exchanger pipes and can, for example, have a ratio of 1:9.4 in pipe bundle heat exchangers used in furnace carbon black plants. With such a design, nozzle spacings of between 90 and 150 mm have been found to be suitable.

The shut-off elements inserted in the flushing gas feed ducts serve to limit the feed of flushing gas to given targeted flushing gas feed ducts. A serial or successive cleaning of the heat exchanger pipes is thus rendered possible. Hence the cleaning periods do not deleteriously affect the continuous process in which the heat exchanger operates.

An embodiment of the apparatus according to the invention is of particular constructional advantage according to which, in heat exchangers having plural pipes, the cleaning gas feed ducts provided with jet nozzles are respectively arranged over a series of pipe lying on a straight or curved line, at least two of these feed ducts lying one above the other and the lower, shorter duct suppling outward-lying, and the upper duct inner-lying nozzles, and the length of the jet nozzles being such that their outlet openings open in the same plane.

In this embodiment, the cleaning gas feed ducts guided through the process gas inflow pipe at the heat exchanger can be rigidly connected, e.g., by welding in, to the inflow pipe, and the uppermost feed duct can be divided into two duct sections, closed at the end and opposite each other at a small spacing. Each section of the uppermost duct thus spans half of the relevant inflow pipe cross section and carries at its outer end a shut-off element. It is further of advantage for the closed ends of these two duct sections to be received in a slide guide, since thermal stresses can thus be avoided and the duct arrangement becomes insensitive to vibration.

As well as the stationary arrangement of the jet nozzles, an arrangement of one or more jet nozzles for displacement away over the openings of heat exchanger pipes has also been found effective, corresponding to the constructional designs as mentioned. Here at least one cleaning gas feed duct carrying at least a jet nozzle is arranged displaceable away over a row of pipes, the central adjustment of the jet nozzle(s) over the gas inlet openings of the heat exchanger pipes being carried out by manually or automatically controlled mechanical, hydraulic, pneumatic or electrical switching elements. The cleaning gas feed duct is here best constructed as a profile pipe which is passed, secure against rotation, through the process gas inflow pipe. Thus for example the cleaning gas feed duct can be constructed as a round pipe with guide fins, slidingly mounted and secured against rotation to the process gas inflow pipe. The constant alignment of the axis of a jet nozzle with the axis of a targeted heat exchanger pipe is thus ensured.

An advantageous variant of the invention which can be applied to all the embodiments described heretofore consists in combining the individual cleaning gas feed ducts into a main duct and building a pressure pulse transducer into the main duct to register the cleaning periods and connected in the region of an orifice built into the main duct or of a venturi pipe built into the main duct.

Finally, since the cleaning action is more intensive the higher the speed of the gas stream, a particularly preferred embodiment of the apparatus according to the invention resides in that the jet nozzles are constructed as Laval nozzles, which enable gas stream speeds above the speed of sound to be reached.

Pipes exposed to a process gas stream containing a hot, finely-dispersed solid, or even a single pipe, of a pipe bundle or single pipe heat exchanger can be unexpectedly easily, and with lasting duration, cleaned of unavoidable deposits of the solid by flushing the pipes during continuous operation of the process with a periodic gas stream, directed centrally into the gas inlet openings of the pipes, released suddenly and maintained briefly at high speed. These process criteria and the modifications set out below are likewise an important part of the invention, in order to ensure reliable function and action during the operation of the apparatus as described.

The flushing gas is to be released suddenly or with an impact, i.e., is to develop its full strength in a period of less than 3 seconds.

The duration of the flushing period is, of course, influenced by the nature of the solid to be cleaned off: its tendency to adhere and aggregate. The cleaning effect increases with the speed of the flushing gas stream, so that a variant of the process according to the invention provides that the gas stream has supersonic speed. This can be produced with Laval nozzles.

A preferred variant of the process resides in flushing the pipes of the heat exchanger during the cleaning cycle by means of the individual cleaning gas ducts and their associated shutoff elements, or by means of jet nozzle traveling over the pipe openings, serially or successively, in order to keep the effects on the heat exchange, running in parallel, and the resultant effects on the whole process, as small as possible.

The duration of the pauses between cleaning periods also has special importance. It has been found to be appropriate to select for the cleaning periods an empirically determined time interval in which none of the heat exchanger pipes, or the single pipe in single pipe exchangers, can fill up with solids.

In pipe bundle heat exchangers, the jacket temperature of the outer pipes, which have been found to be those in greatest danger of being blocked, can be monitored and when an empirical or computed threshold value is exceeded, can release the flushing process when a predetermined value is exceeded.

The choice of the flushing gas is in general determined according to the kind of process gas which transports the solid particles. However, it is important that the flushing gas is dry, so that the deposited solids do not adhere or clump. In the furnace carbon black process, the use of superheated steam with a temperature lying above the gas outlet temperature of the heat exchanger to be cleaned has proved to be effective.

When the process delivering the so-called process gas stream permits it, the flushing gas can also be pulsatingly fed to the jet nozzles. The intermittent gas stream pulses thus transmitted into the exchanger tubes amplify the release of disintegration of covering layers of the solid by a kind of cavitation effect.

Finally, an object of the invention is the use of the cleaning apparatus by use of the cleaning process in heat removal from the process gas of recovery of carbon blacks or fumed inorganic oxides such as silicon dioxide, titanium dioxide, aluminum oxide, Al-Si mixed oxides or oxide mixtures.

Figure 2:
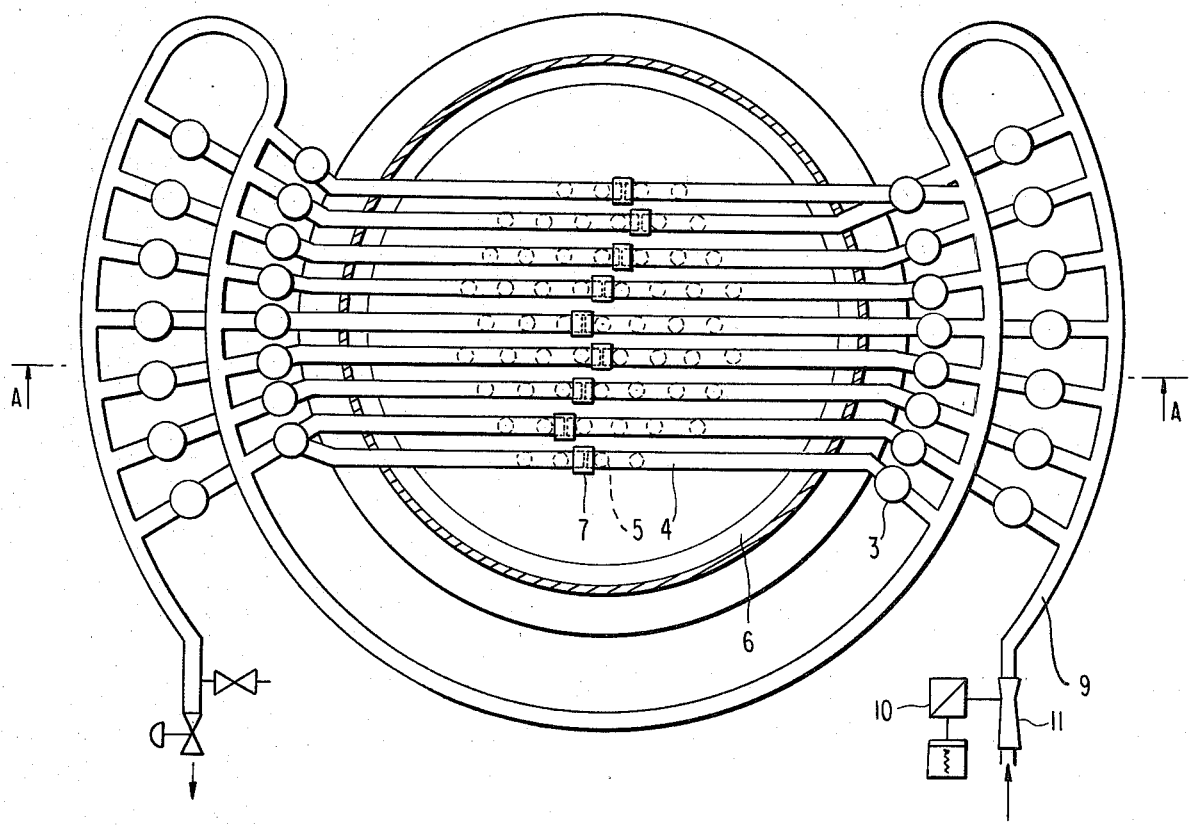
Figure 3:
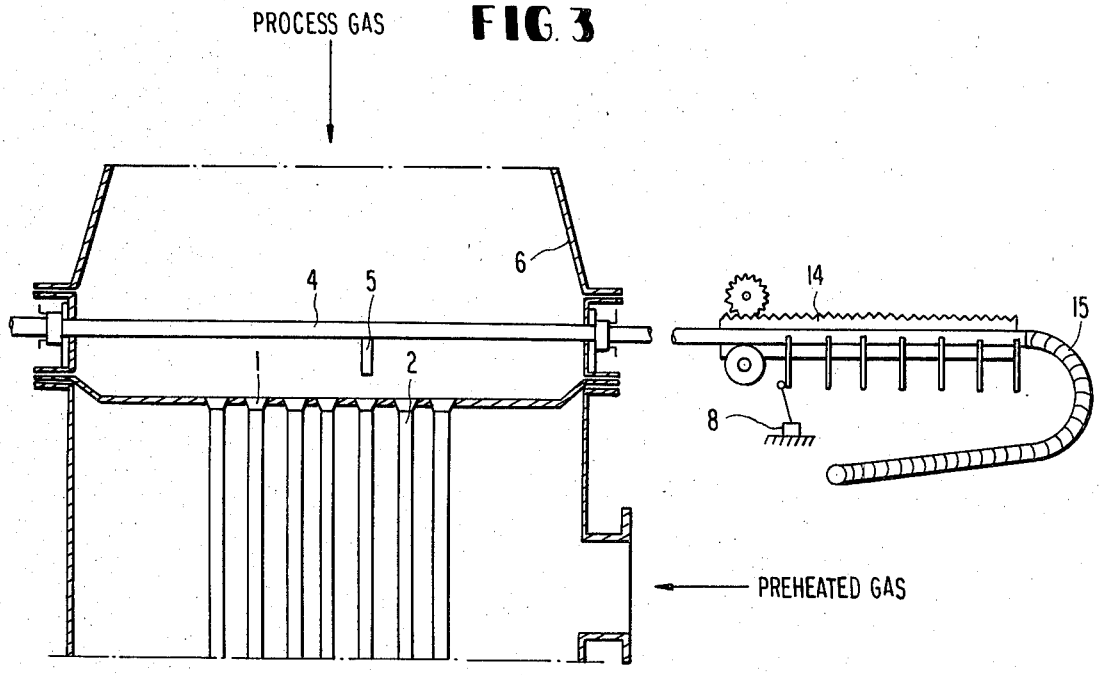
Figure 4:
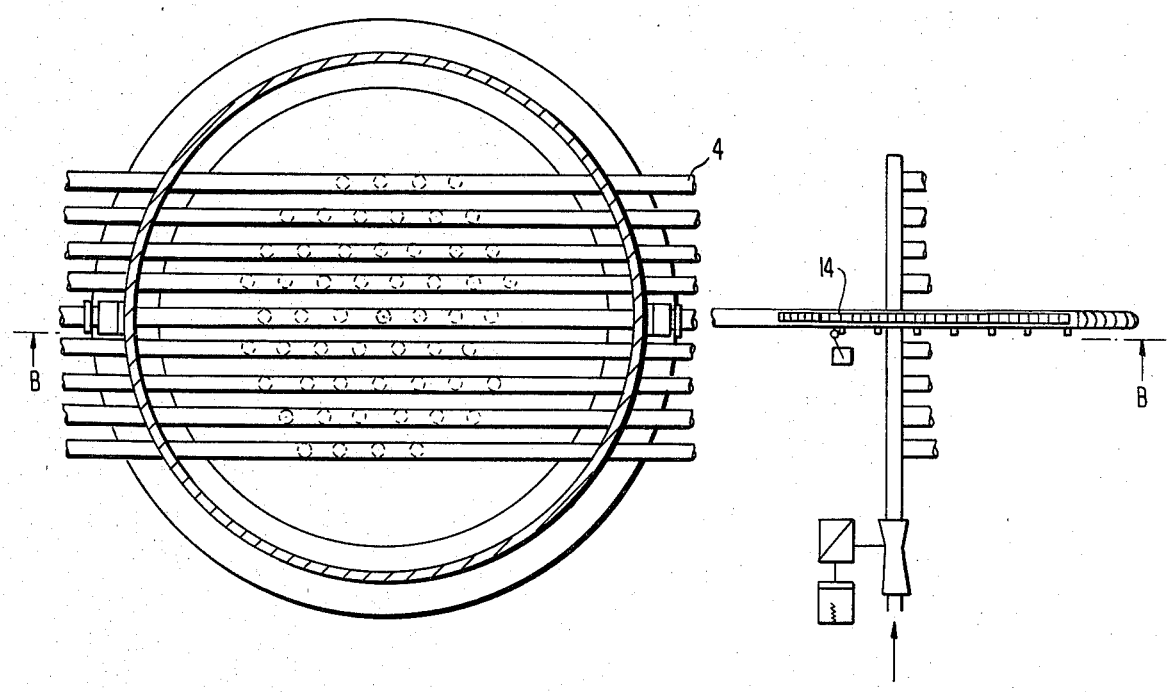

The construction and operation of the apparatus according to the invention are further illustrated below with reference to the accompanying drawings and an example of an embodiment. In the figures, there are shown:

FIG. 1 a side view of the cleaning apparatus arranged in the inflow pipe of a pipe bundle heat exchanger, with fixed jet nozzles, in the section A—A of FIG. 2;

FIG. 2 a plan view of the apparatus of FIG. 1;

FIG. 3 a side view of the cleaning apparatus aranged in the inflow pipe of a pipe bundle heat exchanger, with displaceable jet nozzles, in section B—B of FIG. 4, and FIG. 4 a plan view of the apparatus of FIG. 3.

According to FIGS. 1 and 2, the cleaning apparatus is built into the process gas inflow pipe 6 of a pipe bundle heat exchanger inserted before the filter apparatus for carbon black separation.

The inflow pipe 6 is connected by flanges 12 to the jacket of the heat exchanger; it can also, therefore, be part of the heat exchanger. The exchanger tubes 2, of 43.1 mm internal diameter, have their inlet openings for the process exhaust gas containing carbon black particles opening into the bores of a holding and distribution plate 13, to which they are welded. Jet nozzles 5 with a nozzle diameter of 14 mm open centrally over the gas inlet openings 1 and at a small spacing (about 100 mm) from them. The nozzles 5 for the inner pipes are seated on the upper cleaning gas feed ducts 4, and the nozzles 5' for the outer pipes on the lower flushing gas feed ducts 4'. The respective ducts 4', guided with their rearward sections through the inflow pipe 6 and rigidly connected to it, are connected firmly at their upper sides to the lower side of the ducts 4 by welding. Opposed ducts 4 span about the half cross section of the inflow pipe 6 and are received at their closed ends in a slide sleeve 7, a respective duct end being fast to the sleeve and the corresponding duct end being displaceably pushed displaceably into the sleeve.

A shutoff element 3 for control of the flushing gas is provided in each of the flushing gas feed ducts, outside the inflow pipe. The individual feed ducts for the cleaning gas are combined to a main duct 9 in which a pressure pulse transducer 10 is connected in the region of a venturi tube 11. The guiding, curved about the inflow pipe, of the collecting and main duct not only reduces the space requirement but also particularly simplifies the heat protection measures against condensate formation within the pipe system.

In carrying out the cleaning process in the apparatus according to FIGS. 1 and 2, flushing streams are allowed to emerge from the nozzles 5, 5' within a predetermined time interval or by means of a temperature signal taken at the jackets or gas exit openings of outer tubes by a sudden opening of shutoff elements 3. They produce a strong gas acceleration in the pipes 2, so that the fine carbon black particles adhering to the pipe walls are released and carried away. Although it is basically possible, not all the nozzles are operated simultaneously, but they are operated serially or successively. By this means, flushing practically does not disturb the operation of the heat exchanger, and the flushing gas feed ducts can be economically dimensioned.

In the apparatus according to FIGS. 3 and 4, profile tubes 4, mounted displaceably but secured against rotation in the inflow pipe wall at opposite locations, and connected externally with a rack drive 14, carry individual nozzles 5 which are successively displaced away over a respective row of pipes and are respectively held above the openings 1 of heat exchanger pipes 2 and centrally adjusted by switch organ 8. Flushing gas feed to the pipes 4 is here effected via flexible ducts 15.

EXAMPLE

In a plant for the production of furnace carbon black, a powdery carbon black with the following test data is produced:

| | | | |
|---|---|---|---|
| Iodine absorption | (DIN 53,582) | mg/g | 46 |
| Nitrogen surface | (DIN 66,131) | $m^2/g$ | 45 |
| Particle diameter: | | | |
| by electron microscope | | nm | 41 |
| DBP absorption | (DIN 53,601) | ml/100 g | 125 |
| Color density | | | |
| IRB 3 = 100 | (DIN 53,234) | % | 70 |
| pH value | (DIN 53,200) | | 9.5 |

The production of this carbon black is effected by producing a stream of hot combustion gases by reaction of air with fuel (e.g., combustion gas) and spraying in a highly aromatic carbon black raw material into the hot combustion exhaust gases. After formation of the carbon black, water is sprayed in and the carbon black containing exhaust stream is passed first through a system of heat exchangers and then through filters which separate the carbon black from the exhaust gas.

In the present case, a stream of exhaust gas of 6,250 $Nm^3/h$ with a temperature of 780° C. was fed into the first heat exchanger. About 1,050 kg/h of the carbon black defined above were contained in this exhaust gas stream, which contained water vapor. The exhaust gas freed of moisture has the following composition:

| | |
|---|---|
| Nitrogen | 61.9% |
| Hydrogen | 201.% |
| Carbon monoxide | 13.8% |
| Carbon dioxide | 4.1% |
| Methane | 0.1% |

The carbon black/exhaust gas mixture was cooled in the heat exchanger to 570° C. with 3,300 $Nm^3/h$ of process air.

In order to now be able to supply the carbon black containing exhaust gas to a filter equipped with glass filter flexible tubes, the temperature had to be reduced to 280° C. or below. For this, the exhaust gas was fed to a second heat exchanger which had the following constructional data:

Pipes conducting exhaust gas: 57 pieces, 43.1 mm i.d., 13060 mm length.

This heat exchanger was supplied on the cold air side with 12,000 $Nm^3/h$ of air at 70° C. Simultaneously, the pipes carrying exhaust gas (mostly two pipes together) were flushed suddenly for 3 seconds with 0.83 kg of steam at 310° C., the steam having an outlet speed of 960 m/sec. The flushing cycle was shut off after 90 sec., and a dead time of 7 minutes followed. With this operating mode, the heat exchanger cooled the carbon black containing exhaust gas from 570° to 280° C. The pressure drop in the heat exchanger was 65 mbar. A water spray following the heat exchanger, to reduce the temperature to the permissible temperature of the succeeding flexible tube filter, was not required.

For comparison, the same conditions were maintained in the carbon black production plant and in the heat exchanger/separator plant, but the steam flushing was turned off. After only 60 minutes, the heat exchanger only cooled the carbon black containing exhaust gas from 570° to 350° C., and the pressure drop rose to 95 mbar.

This experiment demonstrates the following advantages of the operating mode according to the invention.

1. Steam flushing keeps the heat exchanger pipes free and the pressure drop low.
2. The low pressure drop enables higher quantitative throughputs to be obtained.
3. Steam flushing enables more heat to be extracted from the carbon black containing exhaust gas, so that it can be passed directly into a flexible tube filter.
4. Without steam flushing, water has again to be sprayed following the heat exchanger, and this leads to poorer quality carbon black due to nodule formation.

We claim:

1. An apparatus for the periodic cleaning out of deposits of solids from pipes of a heat exchanger used for heat removal from a process gas flowing therethrough which contains hot, finely dispersed solids, said apparatus comprising jet nozzles adjusted centrally above the process gas inlet openings of said pipes and connected to feed ducts provided with shut-off elements for the periodic feed of a cleaning gas having an excess pressure relative to the process gas, wherein each of said feed ducts bears a series of jet nozzles arranged over a series of said pipes lying in one line, at least two of said feed ducts lying one above the other, the lower duct being shorter and supplying cleaning gas to the outer lying nozzles in said series and the upper duct supplying cleaning gas to the inner lying nozzles in said series, the length of said jet nozzles being dimensioned such that their outlet openings lie in the same plane.

2. The apparatus according to claim 1 wherein the feed ducts for the cleaning gas, guided through the process gas inflow pipe at the heat exchanger, are rigidly connected to the inflow pipe and the upper feed duct is divided into two duct sections opposite each other at a short mutual distance and closed at their ends.

3. The apparatus according to claim 2 wherein the ends of the two duct sections are taken up in a slide guide.

4. The apparatus according to claim 1 wherein the individual feed ducts for the cleaning gas are combined into a main duct and a pressure pulse transducer is mounted in said main duct for registering the cleaning periods.

5. The apparatus according to claim 4 wherein the pressure pulse transducer is connected in the region of an orifice built into the main duct or of a venturi tube built into the main duct.

6. The apparatus according to claim 1 wherein the jet nozzles are constructed as Laval nozzles.

7. A process for cleaning deposits of solids from pipes of a heat exchanger exposed to a process gas stream containing hot, finely dispersed solids, which comprises the steps of periodically flushing said pipes during the continuous operation of the process with a high speed cleaning gas stream having an excess pressure relative to the process gas stream by directing said cleaning gas stream into the process gas inlet openings of the pipes through jet nozzles adjusted centrally above said openings and connected to feed ducts provided with shut-off elements, each of said feed ducts bearing a series of jet nozzles arranged over a series of said pipes lying in one line, at least two of said feed ducts lying one above the other, the lower duct being shorter and supplying cleaning gas to the outer lying nozzles in said series and the upper duct supplying cleaning gas to the inner lying nozzles in said series, the length of said jet nozzles being dimensioned such that their outlet openings lie in the same plane, releasing said high speed cleaning gas suddenly and maintaining said periodic flushing for a short time.

8. A process according to claim 7 characterized in that the cleaning gas stream has supersonic speed.

9. The process according to claim 7 wherein the pipes are serially and/or successively flushed during a cleaning cycle by means of shut-off elements for the cleaning gas associated with the individual ducts.

10. The process according to claim 7 wherein an empirically determined time interval is chosen for the cleaning period in which none of the heat exchanger pipes can build up with solids.

11. The process according to claim 7 wherein said pipes are arranged in a bundle and wherein the jacket temperature of the outer pipes in said bundle is monitored and when said temperature falls below an empirical or computed threshold value the flushing process is initiated.

12. The process according to claim 7 wherein said pipes are arranged in a bundle and wherein the temperature of the process gas flowing out of the outer pipes in said bundle is monitored and when a predetermined threshhold value is exceeded the flushing process is initiated.

13. The process according to claim 7 wherein said periodic flushing is with superheated steam or dry gases.

14. The process according to claim 7 wherein said periodic flushing is with a pulsating gas stream.

15. A process for the recovery of heat and carbon black or pyrogenic inorganic oxides from a process gas, which comprises the steps of feeding said process gas to the pipes of a heat exchanger, periodically flushing said pipes with a high-speed cleaning gas stream having an excess pressure relative to the process gas stream by directing said cleaning gas stream into the process gas inlet openings of the pipes through jet nozzles adjusted centrally above said openings and connected to feed ducts provided with shut-off elements, each of said feed ducts bearing a series of jet nozzles arranged over a series of said pipes lying in one line, at least two of said feed ducts lying one above the other, the lower duct being shorter and supplying cleaning gas to the outer lying nozzles in said series and the upper duct supplying cleaning gas to the inner lying nozzles in said series, the length of said jet nozzles being dimensioned such that their outlet openings lie in the same plane, and separating the carbon black or pyrogenic inorganic oxides from the process gas stream.

* * * * *